United States Patent [19]

Thomsen

[11] Patent Number: 4,746,056

[45] Date of Patent: May 24, 1988

[54] METHOD OF JOINING TUBULAR STEEL LATTICE MEMBERS AND A DEVICE FOR USE IN THE EXECUTION OF THE METHOD

[76] Inventor: Kjeld Thomsen, Fagerbo 18, 2950 Vedbaek, Denmark

[21] Appl. No.: 5,724

[22] Filed: Jan. 21, 1987

[30] Foreign Application Priority Data

Jan. 23, 1986 [DK] Denmark ..... 350/86

[51] Int. Cl.[4] ..... B23K 31/02; B23K 31/06

[52] U.S. Cl. ..... 228/170; 228/182; 228/189; 52/637; 52/648; 403/171; 403/219; 403/270

[58] Field of Search ..... 228/170, 182, 189; 403/169, 171, 219, 265, 267, 270; 52/637, 648, 650; 29/150, 155 R, 155 C

[56] References Cited

U.S. PATENT DOCUMENTS 592,991 11/1897 Lewis ..... 228/170
3,399,914 9/1968 Grant ..... 52/648
3,613,107 10/1971 Cavagnero ..... 228/170
4,145,149 3/1979 Ruga ..... 403/171

FOREIGN PATENT DOCUMENTS 2904330 8/1979 Fed. Rep. of Germany ..... 52/648
992681 1/1983 U.S.S.R. ..... 52/648

*Primary Examiner*—Nicholas P. Godici
*Assistant Examiner*—Richard K. Seidel
*Attorney, Agent, or Firm*—Larson and Taylor

[57] ABSTRACT

When joining tubular steel lattice members in a space structure, which is built up over box-shaped modules, and where the members (1,5) are joined in the corners of the box-shaped modules under formation of lattice nodes (4), elliptical assembling devices (6,12) are used. The elliptical assembling devices consist of two elliptical plate pieces (7,8) which are placed at right angles to each other with a mutual minor axis. The devices lie with their side backing to member ends, which are cut into plane sections at an angle of 45° with the member axis.

5 Claims, 7 Drawing Sheets

Figure 1:
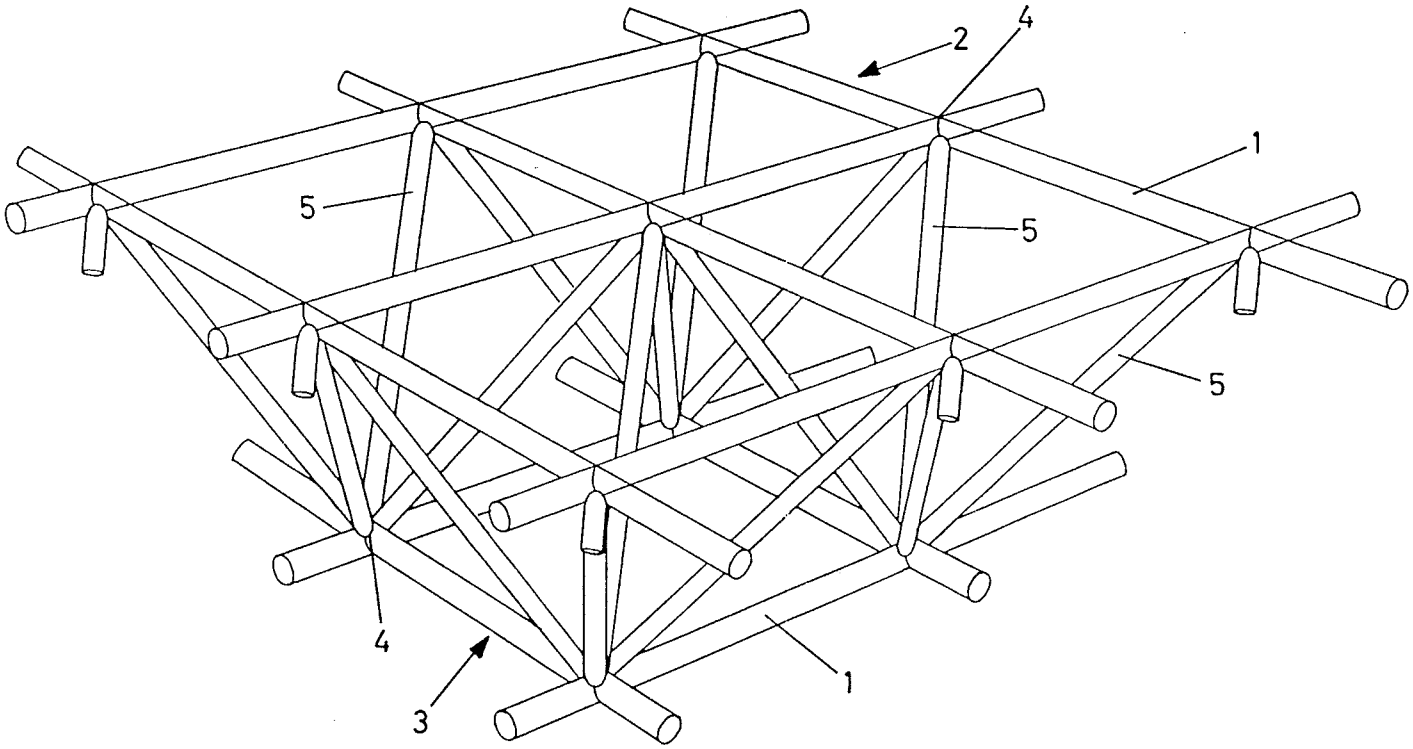

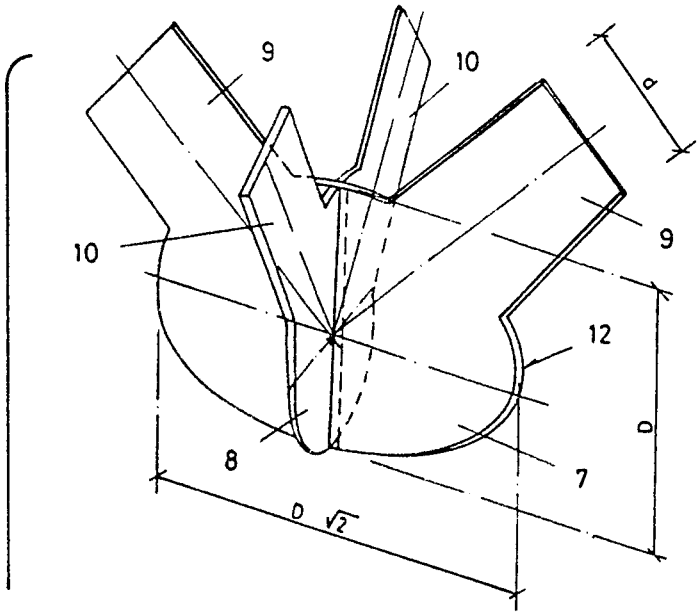
FIG. 4
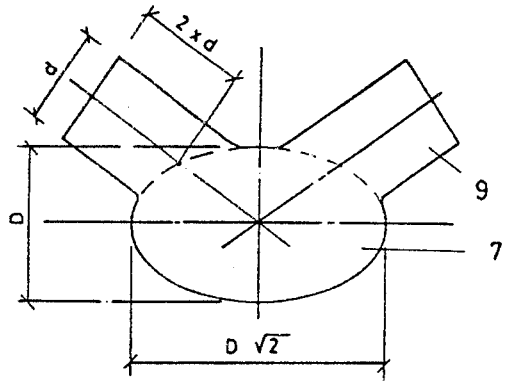
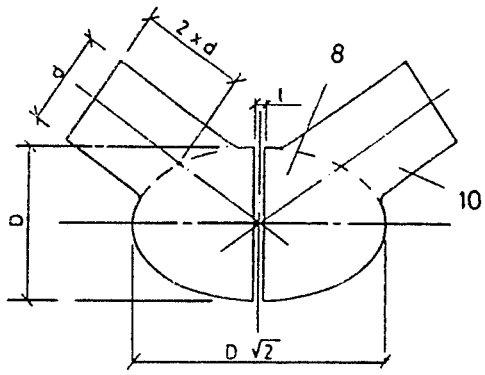

METHOD OF JOINING TUBULAR STEEL LATTICE MEMBERS AND A DEVICE FOR USE IN THE EXECUTION OF THE METHOD

The invention concerns a method of joining tubular lattice members of steel or another weldable material in a space structure, which is built up over box-shaped modules, and where the members are joined in the corners of the box-shaped modules under formation of lattice nodes. Furthermore, the invention concerns a device for use in the execution of the method.

Many methods of joining lattice members in the lattice nodes of a space lattice structure are known.

Within one main group of known assembling methods more or less complicated devices are used, which all imply a difficult assembling and a complicated preceding shaping. Within this group more devices thus exist wherein threaded holes have been made to receive threaded pins on or in the members intended for the joint. In the French PS No. 1,489,468 and the Danish PS No. 134,191 spherical assembling devices with threaded holes for the special screws assembled in the cut lattice members are thus specified. These constructions are difficult to produce and to assemble as heavy demands are made on the accuracy with a view to the mutual lining-up of the members at the assembling place.

Within another main group of lattice node joints the members are joined without the use of devices, the members being cut off along complicated space curves and placed against each other, whereafter welding is made along the space curves between members and cut member ends. It is obvious that this mehod is complicated when use is made of members with a comparatively large cross section as an accurate sharpening of the curved cut has to be made to ensure uniform welds in the whole length of the groove. Moreover, it is utmost difficult to calculate the strength of the joint due to the three-dimensional distribution of stresses in the tube walls.

It is the purpose of the invention to point out a simpler method of joining the lattice members in a space structure as it must be possible to join the members merely by welding and without other preparation of the members than cutting off these in a plane cut The devices used must be simple to shape and to assemble.

This purpose is according to the invention achieved by a method of the kind mentioned by way of introduction, which is characterized in (a) that the members made for placing in the same plan are cut off at an angle of 45° with their longitudinal axes in two plane sections, (b) that four cut member ends are placed at mutually right angles to an assembling device which contains four mutually perpendicular half-elliptical planes, which has a circumference fitting the cut member ends, (c) that the member ends adjoining each other are welded together with I-welds towards the backing provided by the half-elliptical planes, and (d) that oblique space lattice members are welded to the lattice nodes thus formed by means of welding to the top sides of the members.

When cutting the members into plane end sections at an angle of 45° with the longitudinal axis, elliptical circumferences are achieved which can by uniform dimensions of the members be joined directly. The application of an assembling device with mutually perpendicular planes gives a stable form as regards strength as by a suitable thickness of material a very rigid joint is achieved which has a strength equal to or larger than the members. When welding correctly, it will be possible to dimension the structure based on a very simple calculation of tensile and compressive stresses in the members of the structural system as the nodes will always have a strength higher than or equal to that of the member.

The purpose of the invention is furthermore achieved by a device which consists of two elliptical plates of steel or another weldable material, whereby the elliptical plates are placed at right angles to each other with congruent minor axis, the minor axis having the length D and the major axis the length $D \times \sqrt{2}$, where D=diameter of the members made for placing in the same plan.

This element is very simple to produce as for instance uniform elliptical plates can be cut out with said lengths of the major axis and the minor axis. One of the plates is cut through with a thickness of the groove fitting the thickness of the plate, and three parts can thereafter be joined by welding along the mutual minor axis with two butt welds. The welded plate device hereafter forms a very rigid cross where the plates form a well-defined backing for the welds between the cut member ends to be found.

When embodying a device according to the invention, the elliptical plates are extended with legs to receive slotted, oblique space lattice members.

In this way a prospect of a tight welding of the oblique members is opened through a slot known in itself of these ends along an axial section with a width of groove fitting the thickness of the leg. The forces of the oblique members are thus in a suitable way transferable into the rigid cross device in the middle of the lattice node.

The plate legs can according to the invention be formed with a width d and a length 2d, where d=the inner diameter of a tubular, oblique space lattice member.

Thus, a strength is ensured in the joint which corresponds to the strength of the attached lattice member.

The thickness of the plate of the elliptical device can according to the invention equal $K+\frac{1}{4}\times q$, where K=10 mm, and where q=the thickness of material in the tubular lattice members in the same plan as the thickness of the plate of the elliptical device is in any case chosen not to be less than 10 mm.

Calculations have showh that by following these simple instructions of dimension with said thickness of material a larger strength will always be achieved in the lattice node joint than in the tubular members proper between these.

Figure 2:
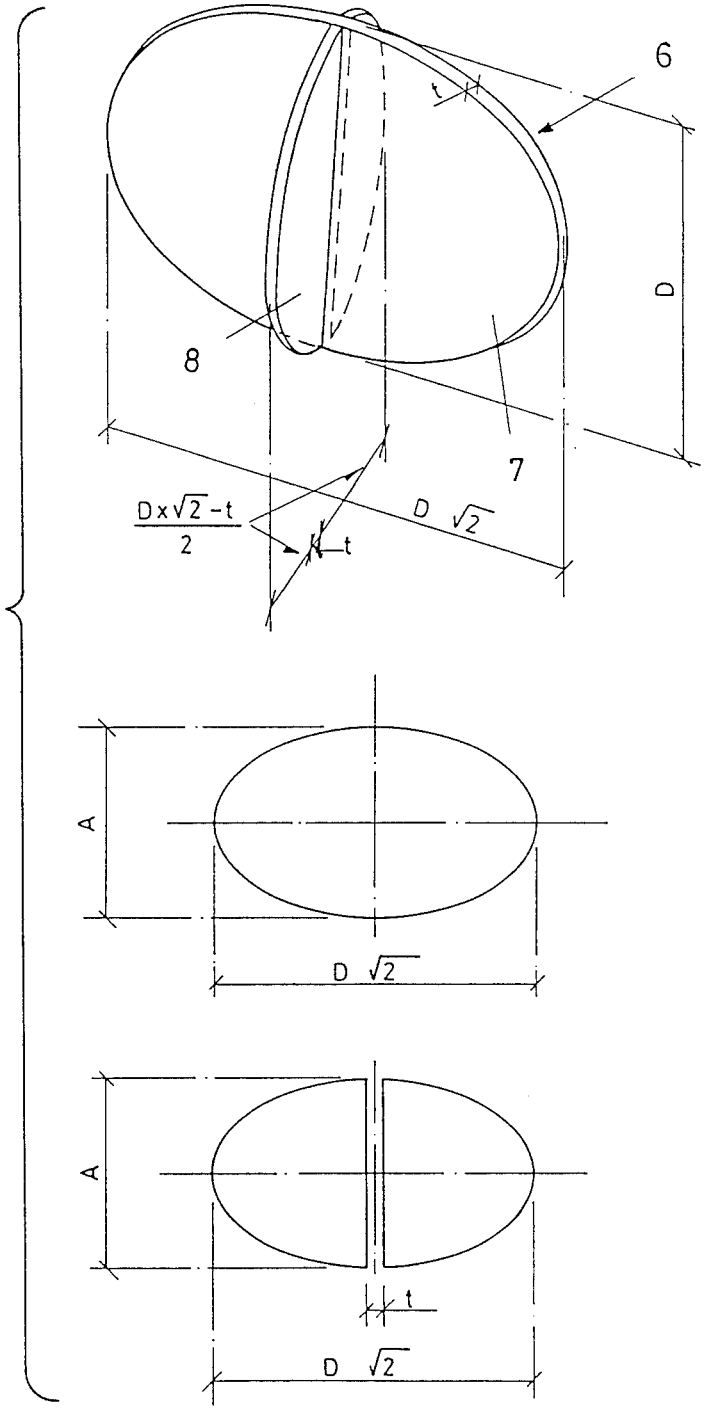
Figure 3:
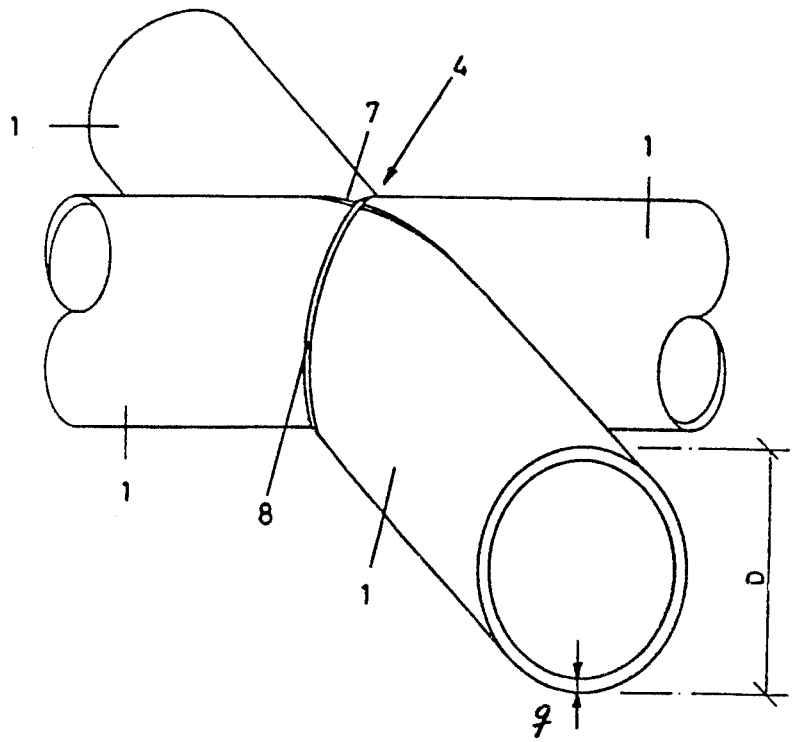

The invention is in the following further explained with references to the illustrations, in which FIG. 1 shows in an oblique picture a space lattice structure joined following a method according to the invention, FIG. 2 shows a first embodiment of an assembling device according to the invention, FIG. 3 schematically shows a lattice node joint between four tubular members lying at the same plan joined by means of the device according to FIG. 2.

Figure 5:
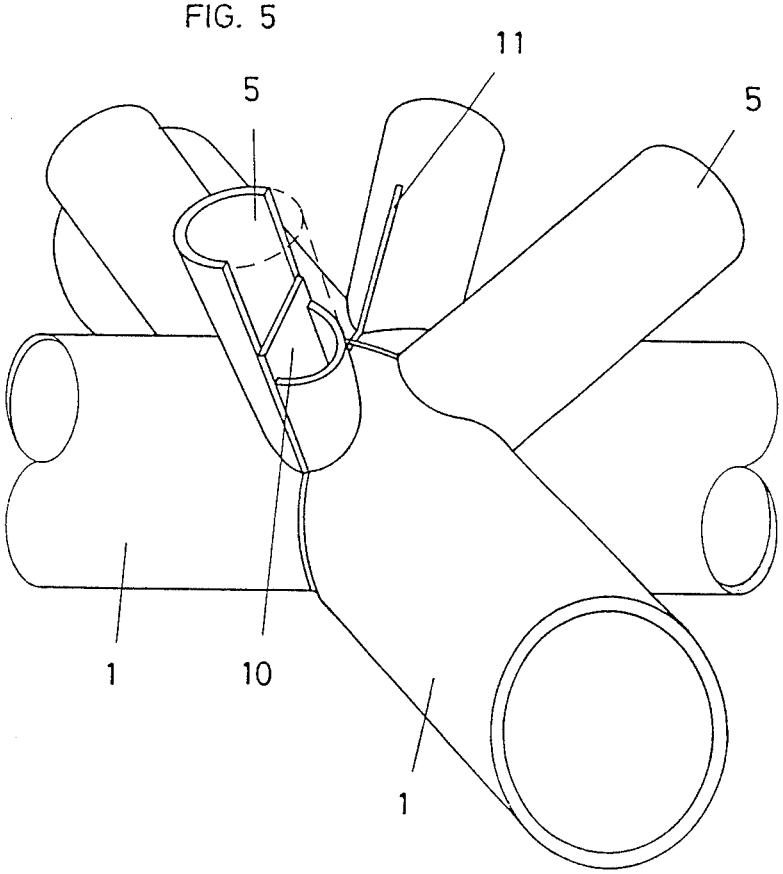
Figure 6:
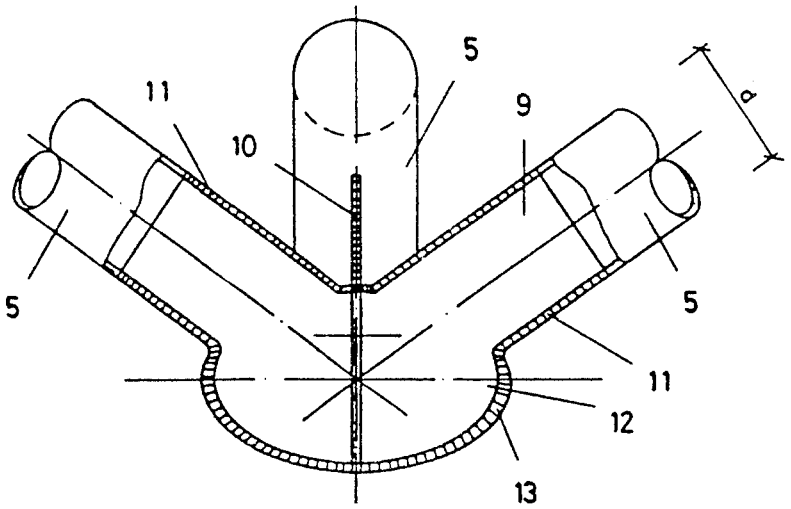
Figure 8:
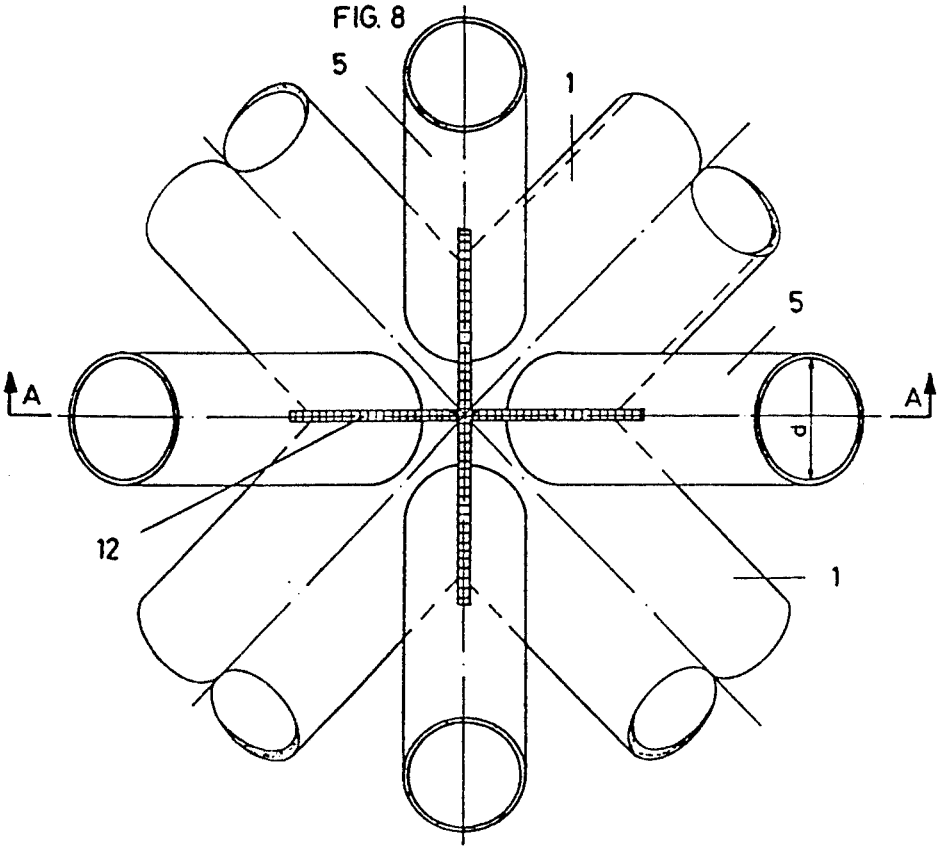
Figure 7:
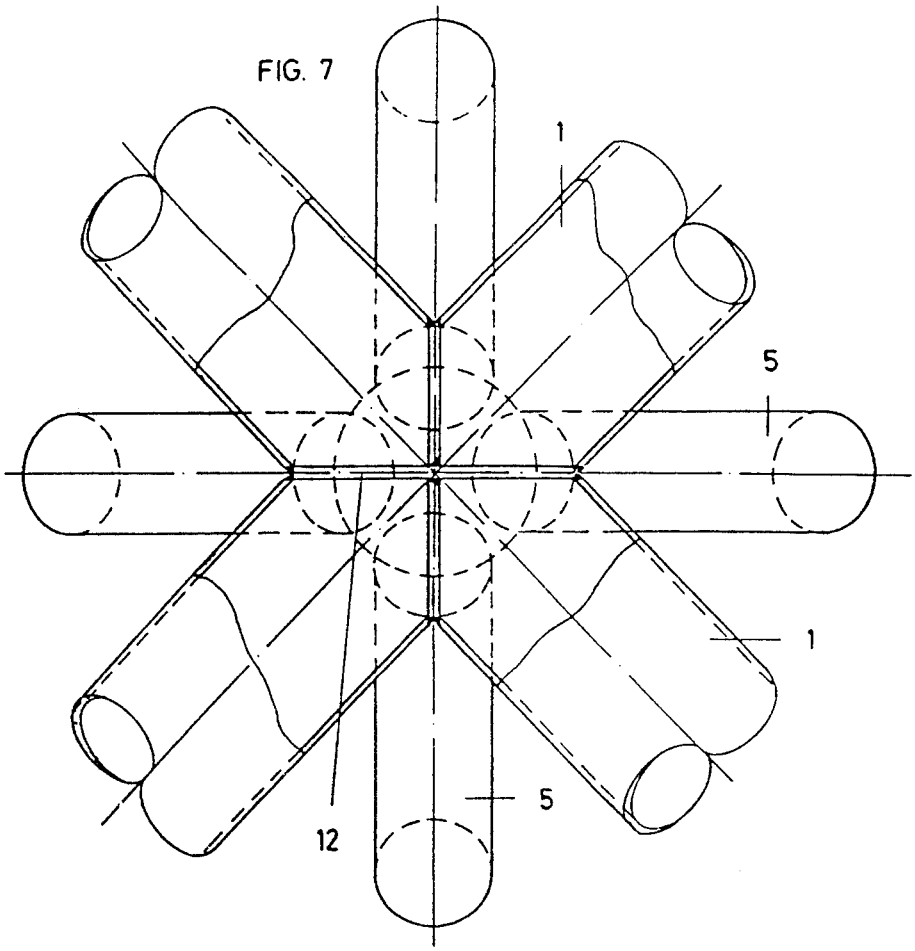

FIG. 4 shows a further embodiment of an assembling device according to the invention, FIG. 5 schematically shows a lattice node joint corresponding to the one shown in FIG. 3, but with use being made of the device according to FIG. 4 and with four additional oblique space members, FIG. 6 shows a cross section through a lattice node joint according to the line A—A of FIG. 8, FIG. 7 shows a lattice node joint seen from below, and FIG. 8 shows the same, seen from above.

The space lattice structure shown in FIG. 1 consists of planar members 1 in the same plan, which together form flange areas 2 and 3 in the space lattice structure. The planar members 1 cross each other at right angles in lattice nodes 4. The planar members form square cells at the embodiment shown, where the squares in the upper flange area 2 are displaced half a square side length compared to the squares in the lower flange area 3. The lattice nodes 4 in the upper and the lower areas are connected with oblique shape members 5, which form pyramids between the two flange areas 2 and 3.

At the embodiment shown the planar members 1 have substantially larger cross sections than the oblique members 5.

In FIG. 2 an assembling device is shown in accordance with the invention. The device 6 consists of two elliptical plate pieces 7 and 8 with the thickness of material t. The plate pieces 7 and 8 are at right angles to each other and are joined along the mutual minor axis by means of welding as one of the ellipses is cut through beforehand as suggested in the bottom part figure of FIG. 2.

The elliptical plates have a minor axis with the length D corresponding to the diameter of the planar members 1 and a major axis with the length of $D \times \sqrt{2}$.

FIG. 3 shows two tubular planar members 1, which are joined in a lattice node 4 by means of a device 6 of the kind shown in FIG. 2. The planar members 1 are at the ends cut into plane sections at an angle of 45° with the tube axis and therefore lie against the backing provided by the plate pieces 7 and 8 along the cut tube end planes. The joint is made by fill up welding in the grooves towards backing provided by the plate pieces.

The embodiment of an assembling device 12 according to the invention shown in FIG. 4 has legs 9 and 10, respectively, extending from the plate pieces 7 and 8. Said legs are arranged to receive slotted oblique members 5 as outlined in FIG. 5. After the placing of the oblique members 5, welding is made along the backing provided by the legs whereby welds 11 are formed.

In FIG. 6 a cross section through the lattice node joint according to FIG. 5 is shown. For the sake of clearness the planar members 1 are only suggested with the welds 13.

FIGS. 7 and 8 show lattice node joints seen from below and from above, respectively.

It should be noted that it will be possible to carry out further modifications of the elliptical assembling devices when adding legs or projection hereon. It could for example prove useful to use specially formed assembling devices with projecting arms in nodes over supports for the total lattice structure.

Likewise, it is within the frames of the invention to form the assembling devices with holes or apertures for lead-in of cables and wires.

I claim:

1. A method of joining tubular lattice members of a weldable material in a space structure which is built up over box-shaped modules, and where the members are joined in the corners of the box-shaped modules under formation of lattice nodes, said method comprising the steps of:

(a) shaping one of the ends of each of respective four first members in two plane sections at an angle of 45° to the longitudinal axes of said respective first members for abutting placement in the same plane, (b) placing said shaped ends of said four first members at right angles to an assembling device having four orthogonal half-elliptical surfaces and each surface having a circumference which fits with respective said abutting shaped ends of said first members to form a backing, (c) welding abutting shaped ends of said four first members together with I-welds towards the backing provided by the half-elliptical surfaces of said assembly device to form lattice nodes, and (d) welding oblique space lattice members to respective said lattice nodes.

2. A method in accordance with claim 1 wherein said assembly device comprises two elliptical plates of a weldable material placed at right angles to each other with congruent minor axis, the minor axis having a length equal to the diameter of said first members and a major axis equal to the product of the diameter of said first members and the square root of two.

3. A method in accordance with claim 2 wherein each of said oblique space lattice members further comprise a slot in one end thereof and each of said elliptical plates further comprises at least two legs for receiving said slotted, oblique space lattice members.

4. A method in accordance with claim 3 wherein said legs have a width substantially equal to the inner diameter of one of said slotted, oblique space members and a length substantially equal to twice the inner diameter of said slotted, oblique space member.

5. A method in accordance with claim 2 wherein said elliptical plates have a thickness substantially equal to ten millimeters plus one quarter of the wall thickness of said first members.

* * * * *